US007567224B2

(12) United States Patent
Choi

(10) Patent No.: US 7,567,224 B2
(45) Date of Patent: Jul. 28, 2009

(54) DEVICE AND METHOD FOR DRIVING A PLASMA DISPLAY PANEL

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 580 days.

(21) Appl. No.: 10/866,080

(22) Filed: Jun. 14, 2004

(65) Prior Publication Data

US 2004/0257306 A1 Dec. 23, 2004

(30) Foreign Application Priority Data

Jun. 13, 2003 (KR) ..... 10-2003-0038127

(51) Int. Cl.
*G09G 3/28* (2006.01)

(52) U.S. Cl. ..... 345/60

(58) Field of Classification Search ..... 345/60–70, 345/72

See application file for complete search history.

(56) References Cited

U.S. PATENT DOCUMENTS 6,876,343 B2 * 4/2005 Myoung et al. ..... 345/67
2001/0017606 A1 * 8/2001 Choi ..... 345/60
2003/0201726 A1 * 10/2003 Kang et al. ..... 315/169.1
2005/0082957 A1 * 4/2005 Hoppenbrouwers et al. .... 313/3

FOREIGN PATENT DOCUMENTS

KR 10-2002-0032927 5/2002

* cited by examiner

*Primary Examiner*—Bipin Shalwala
*Assistant Examiner*—Steven E Holton
(74) *Attorney, Agent, or Firm*—KED & Associates, LLP

(57) ABSTRACT

The present invention relates to a driving device and a driving method of a plasma display panel that lowers power consumption and enables high-speed driving. The driving device of the plasma display panel includes a data-loading detection part that comprehends data-loading provided for each of subfields and generates a first control signal and a second control signal in response to the data-loading, a direct current voltage supply part that provides direct-current voltage in response to the first control signal from the data-loading detection part, an energy recovery circuit that provides data voltage in response to the second control signal from the data-loading detection part, and address driving part that generates data pulse with either direct-current voltage or data voltage provided by the energy recovery circuit and the direct current voltage supply part.

15 Claims, 17 Drawing Sheets

DEVICE AND METHOD FOR DRIVING A PLASMA DISPLAY PANEL

This Nonprovisional application claims priority under 35 U.S.C. § 119(a) on Patent Application No. 10-2003-0038127 filed in Korea on Jun. 13, 2003, the entire contents of which are hereby incorporated by reference.

BACKGROUND OF THE INVENTION

1. Field of the Invention

The present invention relates to a plasma display panel, and more particularly, to a driving device and driving method of a plasma display panel, which can lower power consumption and enable high-speed driving.

2. Description of the Background Art

A plasma display panel (hereinafter, referred to as "PDP") is a display device using a phenomenon that a phosphor emits visible light when it is excited by ultraviolet ray generated by gas discharge. A PDP has some advantages including that it is thinner and lighter than a cathode ray tube (CRT) that has ever been the mainstream of a display device, and a high-definition large screen PDP can be produced. A PDP is comprised of a matrix of many discharge cells, and each of the discharge cells forms a pixel of a display.

FIG. 1 is an oblique perspective diagram illustrating a discharge cell of an existing alternate current (hereinafter, referred to as "AC") sheet discharge type PDP. Referring to FIG. 1, a discharge cell of a three-electrode AC sheet discharge type PDP includes a scan electrode 12Y and a sustain electrode 12Z that are formed on an upper substrate 10, and an address electrode 20X that is formed on a lower substrate 18. An upper dialectic layer 14 and a protective film 16 are laminated on the upper substrate 10 that the scan electrode 12Y and the sustain electrode 12Z are formed in parallel. Wall charges generated in the plasma discharge are accumulated on the upper dialectic layer 14. The protective film 16 protects damage on the upper dialectic 14 by sputtering generated in the plasma discharge, and increases emission efficiency of secondary electrons. Magnesium oxide (MgO) is generally used for the protective film 16.

A lower dialectic layer 22 and a division wall 24 are formed on the lower substrate 18 that the address electrode 20X is formed, and a phosphor 26 is applied on the surface of the lower dialectic layer 22 and the division wall 24. The address electrode 20X is formed in the direction that crosses the scan electrode 12Y and the sustain electrode 12Z. The division wall 24 is formed in parallel with the address electrode 20X and prevents ultraviolet rays and visible light that are generated in the discharge from leaking into the adjacent discharge cells. The phosphor 26 is excited by ultraviolet rays generated in the plasma discharge, and emits either of red, green, or blue visible light. To generate the gas discharge, inert gases is injected into the discharge space, which is formed among the upper substrate 10, the lower substrate 18, and the division wall 24.

To realize the gradation sequence of an image, one frame of the PDP is divided into some sub-fields with different emission frequency, and the time division driving is conducted. Each sub-field is divided into a reset period RPD to reset a prior screen, an address period APD to select a scan line and select a cell with the selected scan line, and a sustain period SPD to realize the gradation sequence according to the discharge frequency.

The reset period RPD is divided into a full write period that a ramp pulse are provided, and a stabilization period that a stabilization pulse is provided. For example, as is shown in FIG. 2, when an image is displayed with 256-gradation sequence, one frame period, which corresponds to one-sixtieth second (16.67 ms), is divided into eight sub-fields SF1 through SF8. The address period APD in each of the sub-fields has the same length, but length of the sustain period SPD is getting longer in each of the sub-fields at the rate of $2^n$(n=0, 1, 2, 3, 4, 5, 6, 7).

Referring to FIG. 3, an existing driving device of an AC sheet discharge type PDP includes a PDP 30 that a [m×n] matrix of discharge cells 1 is distributed so that it is connected to scan electrode lines Y1 through Ym, sustain electrode lines Z1 through Zm, and address electrode lines X1 through Xn, a scan driving part 32 to drive the scan electrode lines Y1 though Ym, a sustain driving part 34 to drive the sustain electrode lines Z1 through Zm, and a first address driving part 36A that drives odd-numbered lines of the address electrode lines (X1, X3, . . . Xn-3, Xn-1) and a second address driving part 36B that drives even-numbered lines of the address electrode lines (X2, X4, X6 . . . Xn-2, Xn).

The scan driving part 32 provides a scan pulse and a sustain pulse with the scan electrode lines Y1 through Ym in order, so that each of the discharge cells 1 is sequentially scanned on a line-by-line basis, and it sustains the discharge in the [mxn] discharge cells 1. The sustain driving part 34 provides sustain pulses with all of the sustain electrode lines Z1 through Zm. The first address driving part 36A and the second address driving part 36B provide image data with the address electrode lines X1 through Xn, so that it can synchronize with scan pulses. The first address driving part 36A provides image data with odd-numbered lines of the address electrode lines (X1, X3, . . . Xn-3, and Xn-1), and the second address driving part 36B provides image data with even-numbered lines of the address electrode lines (X2, X4. . . Xn-2, and Xn).

In the AC sheet discharge type PDP that is driven as described above, more than hundreds of volts of high-voltage is required for the address discharge and the sustain discharge. Accordingly, the electric power recovery devices are installed in the scan driving part 32, the sustain driving part 34, and address driving parts 36A and 36B to minimize driving power required for the address discharge and the sustain discharge. The electric power recovery devices recover voltage that is charged in a panel, and re-power the voltage as the driving voltage in the next discharge.

FIG. 4 is a diagram illustrating an existing electric power recovery device that is installed on the anterior end of an address driving part. Referring to FIG. 4, an existing electric power recovery device 40 includes an inductor L that is connected between a first address driving part 36A and an energy recovery capacitor Cs, a first switch S1 and a third switch S3 that are connected between the energy recovery capacitor Cs and the inductor L in parallel, and a second switch S2 and a fourth switch S4 that are connected between the inductor L and the first address driving part 36A in parallel. The panel capacitor Cp expresses the electric capacitance in the discharge cells of PDP equivalently.

The second switch S2 is connected to a voltage Vd, and the fourth switch S4 is connected to a base voltage GND. The energy recovery capacitor Cs recovers and charges voltage that is charged in the panel capacitor Cp in the address discharge, and re-power the charged voltage with the panel capacitor Cp. The energy recovery capacitor Cs charges the voltage of Vd/2, which corresponds to half of the address voltage Vd. The inductor L and the panel capacitor Cp form a sympathetic vibration circuit. When the first through fourth switches S1 though S4 are turned on or turned off, voltage is charged in the energy recovery capacitor Cs or the charged voltage is provided with the panel capacitor Cp.

The first address driving part 36A includes some fifth switches S5 and the sixth switches S6. The fifth switches S5 are connected to the electric power recovery device 40, and the sixth switches S6 are connected to the ground voltage GND. The fifth switches S5 are turned on when data pulses are provided, and they are turned off when data pulses are not provided. On the other hand, the electric power recovery device, which is formed on the anterior end of the second address driving part 36B, is formed symmetrically with the first address driving part 36A and the electric power recovery device 40 around the panel capacitor Cp.

FIG. 5 is timing diagram, which illustrates the on/off timing of each switch that are illustrated in FIG. 4 and a voltage value that is provided with the panel capacitor.

An action process of the electric power recovery device 40 is now explained in detail in reference to FIGS. 4 and 5.

Firstly, it is assumed that a voltage charged in the panel capacitor Cp before a T1 period has a voltage value of zero. It is also assumed that a voltage of Vd/2 is charged in the energy recovery capacitor Cs.

In the T1 period, the first switch S1 and the fifth switches S5 are turned on. At this time, if the discharge cell is not selected, in other words, if data pulses are not provided with the address electrode lines X, the fifth switches S5 sustain the off state. If the first switch S1 and the fifth switches S5 are turned on, a current path, which connects the energy recovery capacitor Cs and the panel capacitor Cp through the first switch S1, the inductor L, and the fifth switches S5, is formed. Accordingly, voltage charged in the energy recovery capacitor Cs is provided with the panel capacitor Cp. At this time, the voltage Vd powers the panel capacitor Cp with voltage, because the inductor L and the panel capacitor Cp form a series-resonant circuit.

In a T2 period, the second switch S2 is turned on. When the second switch S2 is turned on, voltage of the address voltage Vd powers the panel capacitor Cp with voltage. The address voltage Vd, which is provided in the T2 period, prevents voltage of the panel capacitor from falling below the address voltage Vd, and accordingly a stable address discharge can be generated. On the other hand, driving power, which is externally provided to generate the address discharge, is minimized, because voltage of the panel capacitor Cp is raised up to the address voltage Vd in the T1 period.

In a T3 period, the first switch S1 is turned off, and the second switch S2 sustains the on state. Accordingly, the panel capacitor Cp sustains the address voltage Vd in the T3 period.

In a T4 period, the second switch S2 is turned off, and third switch S3 is turned on. If the third switch S3 is turned on, a current path, which connects the panel capacitor Cp and the energy recovery capacitor Cs through the fifth switch S5, the inductor L, and the third switch S3, is formed, and voltage charged in the panel capacitor Cp is recovered by the energy recovery capacitor Cs.

In a T5 period, when the third switch S3 and the fifth switches S5 are turned off, the fourth switch S4 and the sixth switches S6 are turned on. If the fourth switch S4 and the sixth switches S6 are turned on, a current path that connects the ground voltage GND and the panel capacitor Cp is formed, and voltage value of the panel capacitor Cp descends to zero. In fact, an existing electric power recovery device repeats the action process of the T1 through T5 period and simultaneously provides data pulses with the panel capacitor Cp.

However, a data pulse that is provided by the existing electric power recovery device has the wide pulse width. Therefore, the data pulse has a drawback that it cannot be used for the high-speed addressing. This is now explained in detail in reference to FIG. 6. Firstly, the data pulse that is provided by an existing electric power recovery device is divided into a T1 period that voltage is charged in the panel capacitor Cp, a T2 period that address voltage is provided with the panel capacitor Cp, a T3 period that voltage charged in the panel capacitor Cp is recovered and is charged in the energy recovery capacitor Cs, and a T4 period that voltage value in the panel capacitor Cp is descended to zero.

Here, what is actually required for the address discharge is the T2 period, and the T1 period, the T2 period, and the T3 period are the preparatory periods to charge voltage in the capacitors Cs and Cp. In other words, data pulse that is provided by an existing electric power recovery device cannot be used for the high-speed addressing, because it has the preparatory periods T1, T3, and T4 other than the T2 period that is actually required for the address discharge.

To resolve this problem, a electric power recovery device 50A is suggested as is illustrated in FIG. 7.

Referring to FIG. 7, the electric power recovery device 50A includes the inductor L that is connected between a first address driving part 36A and an energy recovery capacitor Cs, the first switch S1 and the third switch S3 that are connected between the energy recovery capacitor Cs and the inductor L in parallel, and the second switch S2 that is connected between the inductor L and the first address driving part 36A. The panel capacitor Cp expresses the electric capacitance of the discharge cell equivalently.

The second switch S2 is connected to the address voltage Vd. The energy recovery capacitor Cs recovers and charges voltage that is charged in the panel capacitor Cp, and simultaneously re-powers the panel capacitor Cp with the charged voltage. At this time, voltage charged in the energy recovery capacitor Cs varies according to provided data. The inductor L and the panel capacitor Cp form the resonance circuit. If the first though third switches S1 through S3 are turned on and turned off, voltage is charged in the energy recovery capacitor Cs or the charged voltage is provided with the panel capacitor Cp.

The first address driving part 36A includes some fourth switches S4 and fifth switches S5. The fourth switches S4 are connected to the electric power recovery device 50A, and the fifth switches S5 are connected to ground voltage GND. The fourth switches S4 are turned on when data pulse is provided, and they are turned off when data pulse is not provided. On the other hand, the electric power recovery device, which is formed on the anterior end of the second address driving part 36B, is formed symmetrically with the first address driving part 36A and the electric power recovery device 40 around the panel capacitor Cp.

FIG. 8 is a timing diagram, which illustrates the on/off timing of each of the switches illustrated in FIG. 7 and the voltage value provided with the panel capacitor.

An action process of the electric power recovery device 50A in the present invention is now explained in reference to FIGS. 7 and 8. Firstly, it is assumed that voltage charged in the panel capacitor Cp before the T1 period has voltage value of zero. It is also assumed that given voltage is charged in the energy recovery capacitor Cs.

In a T1 period, the first switch S1 and the fourth switches S4 are turned on. At this time, if the discharge cell is not selected, in other words, if data pulse is not provided with the panel capacitor Cp, the fourth switches S4 sustain the off state. If the first switch S1 and the fourth switches S4 are turned on, a current path, which connects the energy recovery capacitor Cs and the panel capacitor Cp through the first switch S1, the inductor L, and the fourth switches S4, is formed. The inductor L and the panel capacitor Cp form the series resonance circuit, and address voltage Vd is provided with the panel capacitor Cp.

In a T2 period, the second switch S2 is turned on. If the second switch S2 is turned on, the address voltage Vd is provided with the panel capacitor Cp. At this time, the address voltage Vd, which is provided with the panel capacitor Cp, prevents voltage in the panel capacitor Cp from falling below the address voltage Vd, and accordingly the address discharge can be normally generated.

In a T3 period, the first switch S1 is turned off and the second switch S2 sustains the on state. Therefore, the address voltage Vd is sustained in the panel capacitor Cp during the T3 period.

In a T4 period, the second switch S2 is turned off and the third switch S3 is turned on. When the third switch S3 is turned on, a current path, which connects the panel capacitor Cp and the energy recovery capacitor Cs though the fourth switches S4, the inductor L, and the third switch S3, is formed, and voltage charged in the panel capacitor Cp is recovered by the energy recovery capacitor Cs.

In a T5 period, address pulse is provided with the address electrode lines X by repeating the action in the T1 period. In fact, the data pulse provided with the panel capacitor Cp can be obtained, while the action processes in the T1 through T4 period are periodically repeated.

Also, to resolve the problem that relates to the existing electric power recovery device 40 illustrated in FIG. 4, an electric power recovery device 50B is suggested as is illustrated in FIG. 9.

Referring to FIG. 9, the electric power recovery device 50B includes a inductor L and a first switch S1 that are connected between a first address driving part 36A and a source capacitor Cs, and a second switch S2 that is connected between the inductor L and the first address driving part 36A. When the electric power recovery device 50B illustrated in FIG. 9 is compared with the electric power recovery device 40 illustrated in FIG. 4, it is clear that two switches are connected between the inductor L and the source capacitor Cs in parallel in the electric power recovery device 40, but the first switch S1 is serially connected between the inductor L and the source capacitor Cs in the electric power recovery device 50B. The first address driving part 36A is comprised of the third switch S3 and the fourth switch S4 that are connected between the electric power recovery device 50B and the panel capacitor Cp. The panel capacitor Cp equivalently expresses the electric capacitance formed between each of the address electrode lines X1 through Xn. The second switch S2 is connected to the address voltage Vd, and the fourth switch S4 is connected to the ground voltage GND. The source capacitor Cs recovers and charges the voltage charged in the panel capacitor Cp in the address discharge, and re-power the panel capacitor Cp with the charged voltage. The source capacitor Cs has large capacitance so that voltage of Vd/2 that corresponds to half of the address voltage Vd can be charged. The inductor L and the panel capacitor Cp form a resonance circuit. The third switch S3 is turned on when data pulse is provided, and it is turned off when data pulse is not provided. The electric power recovery device, which is formed on the anterior end of the second address driving part 36B, is formed symmetrically with the first address driving part 36A around the panel capacitor Cp.

FIG. 10 is a timing chart illustrating the on/off timing of each of the switches illustrated in FIG. 9, and a waveform chart illustrating the output by the panel capacitor.

An action process of an electric power recovery device 50B is now explained in reference to FIGS. 9 and 10.

Firstly, it is assumed that voltage charged among address electrode lines X before the T1 period, in other words, voltage charged in the panel capacitor Cp, has voltage value of zero. It is also assumed that voltage of Vd/2 is charged in the source capacitor Cs.

In a T1 period, the first switch S1 and the third switch S3 are turned on. At this time, if the discharge cell is not selected, in other words, if data pulse is not provided with the address electrode lines X, the third switch S3 sustains the off state. If the first switch S1 and the third switch S3 are turned on, a current path that connects the source capacitor Cs and the panel capacitor Cp through the first switch S1, inductor L, and the third switch S3. At this time, the inductor L and the panel capacitor Cp form a series resonance circuit. In the series resonance circuit, voltage in the panel capacitor Cp rises to the address voltage Vd, which is twice as much as voltage in the source capacitor Cs, by the charge and the discharge of the current in the inductor L, because voltage of V/d2 is charged in the source capacitor Cs.

In a T2 period, the second switch S2 is turned on. If the second switch S2 is turned on, the address voltage is provided with the address electrode lines X. Address voltage, which is provided with the address electrode lines X, prevents voltage in the panel capacitor Cs from falling below the address voltage Vd, and accordingly the address discharge can be normally generated. At this time, driving power, which is externally provided to generate the address discharge, is minimized, because voltage in the panel capacitor rises to the address voltage Vd in the T1 period.

In a T3 period, the first switch S1 is turned off, and the address voltage Vd that is provided with the address electrode lines X is sustained.

In a T4 period, the second switch S2 is turned off, and the first switch S1 is turned on. If the first switch S1 is turned on, a current path, which connects the panel capacitor Cp and the source capacitor Cs through the third switch S3, the inductor L, and the first switch S1, is formed, and voltage that is charged in the panel capacitor Cp is recovered by the source capacitor Cs. Voltage in the panel capacitor descends while the panel capacitor Cp is discharged, and at the same time, voltage of Vd/2 is charged in the source capacitor Cs. At this time, a current patch, which connects the source capacitor Cs and the panel capacitor Cp through the first switch S1, the inductor L, and the third switch S3, is formed, because the first switch S1 sustains the on state. That is, the source capacitor starts discharging the panel capacitor Cp after voltage of Vd/2 is charged as is the case with the T5 period. The fourth switch S4 is turned on, if data pulse is not provided with the address electrode lines X. In fact, the data pulse that is provided with the address electrode lines X can be obtained, while the action processes in the T1 through T4 period are periodically repeated.

As is the case with FIG. 11, the data pulse, which is generated in the electric power recovery device 50A illustrated in FIG. 7 and the electric power recovery device 50B illustrated in FIG. 9, is divided into a T1 period that voltage is charged in the panel capacitor Cp, a T2 period that the address voltage Vd is provided with the panel capacitor Cp, and a T3 period that the voltage charged in the panel capacitor Cp is recovered and is charged in the energy recovery capacitor Cs. That is, it is possible to execute the high-speed addressing in the electric power recovery device 50A illustrated in FIG. 7 and the electric power recovery device 50B illustrated in FIG. 9, because the T4 period that voltage in the energy recovery capacitor Cs is sustained at the level of Vd/2 is removed in the electric power recovery devices 50A and 50B.

However, these electric power recovery devices 50A and 50B are operated whenever data pulse is provided with each of the address electrode lines. Therefore, if the small number of data pulse is provided with each of the address electrode lines, in other words, if there is small number of data-loading in each of the address electrode lines, this causes a problem that the power consumption requires more power when the electric power recovery devices 50A and 50B are driven. That is, if the small amount of data-loading is executed in the process to recover power by the electric power recovery devices 50A and 50B to lower power consumption, this causes a problem that power to drive each of parts in the electric power recovery devices 50A and 50B comes to be larger than power to provide data pulse, and accordingly power consumption is increased.

SUMMARY OF THE INVENTION

Accordingly, an object of the present invention is to solve at least the problems and disadvantages of the background art.

An objective of the present invention is to provide a driving module and driving method of PDP that lowers power consumption and enables high-speed driving.

To achieve the objective, the driving device of a plasma display panel in the embodiment of the present invention is comprised of a data-loading detection part that comprehends data-loading provided with each of sub-fields and generates a first control signal and a second control signal in response to the data-loading, a direct current supply part that provides direct current voltage in response to the first control signal from the data-loading detection part, an energy recovery circuit that provides data voltage in response to the second control signal from the data-loading detection part, an address driving part to generate data pulse with either direct current voltage and data voltage that are provided by the energy recovery circuit and the direct current supply part.

A driving device of a plasma display panel in the embodiment of the present invention, which one frame includes at least one selective write sub-field and one selective erase sub-field, includes a sub-field mapping part that generates a first control signal in the selective erase sub-field and generates a second control signal in the selective write sub-field, a direct current voltage supply part that provides direct current voltage in response to the first control signal from the sub-field mapping part, an energy recovery circuit that provides data voltage in response to the second control signal from the sub-field mapping part, an address driving part to generate data pulse with either direct current voltage and data voltage that are provided by the energy recovery circuit and the direct-current supply part.

The driving method of a plasma display panel in the embodiment of the present invention includes a first stage wherein data loading for each of sub-field is comprehended, a second stage wherein either a direct current voltage supply part or an energy recovery circuit is driven in response to the data-loading, and a third stage wherein data pulse is generated with voltage that is provided by either the direct-current supply part or energy recovery circuit.

The driving device and the driving method of a plasma display panel of the present invention upgrade driving efficiency, because an electric power recovery device can be driven with the distinction of driving and non-driving according to the data-loading of video data that is input and the drive method. The driving device and the driving method of a plasma display panel of the present invention enables high-speed driving by the use of an electric power recovery device that can execute the high-speed driving.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
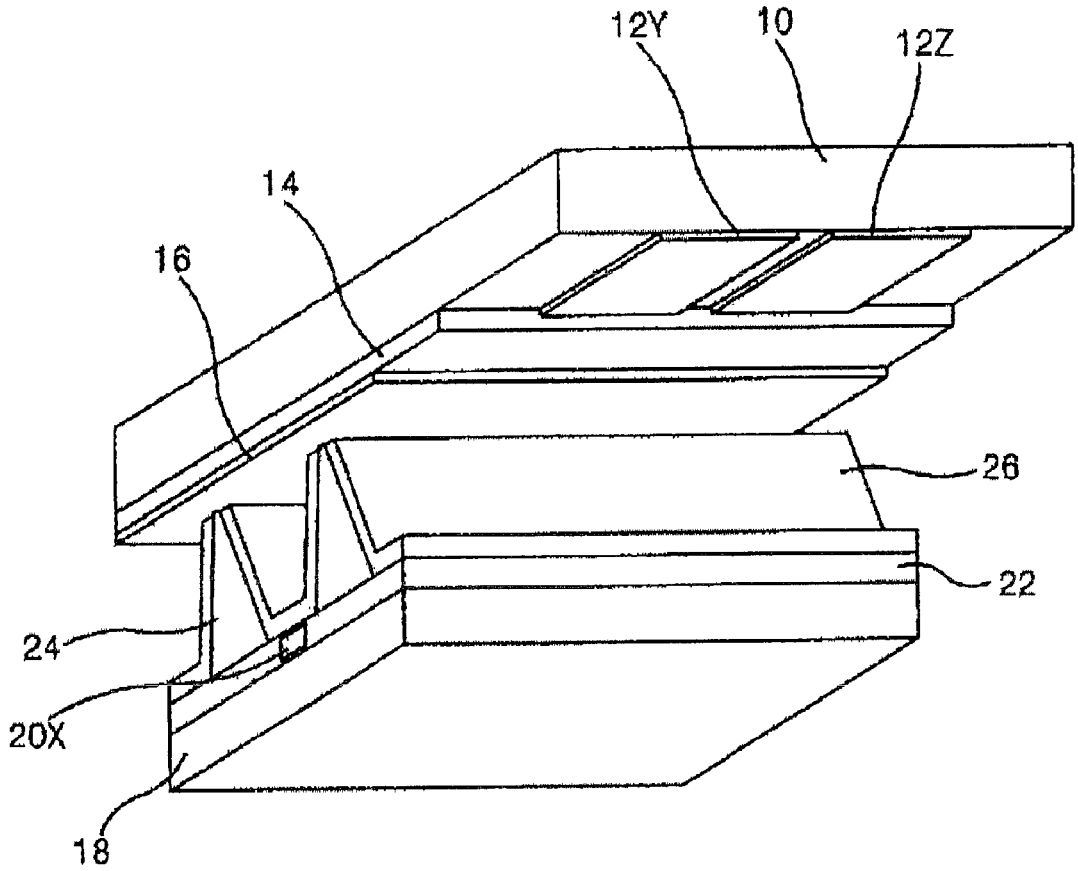
Fig. 1 Prior Art
FIG. 1 is an oblique perspective diagram illustrating the structure of a discharge cell in an existing three-electrode AC sheet discharge type plasma display panel.
Figure 2:
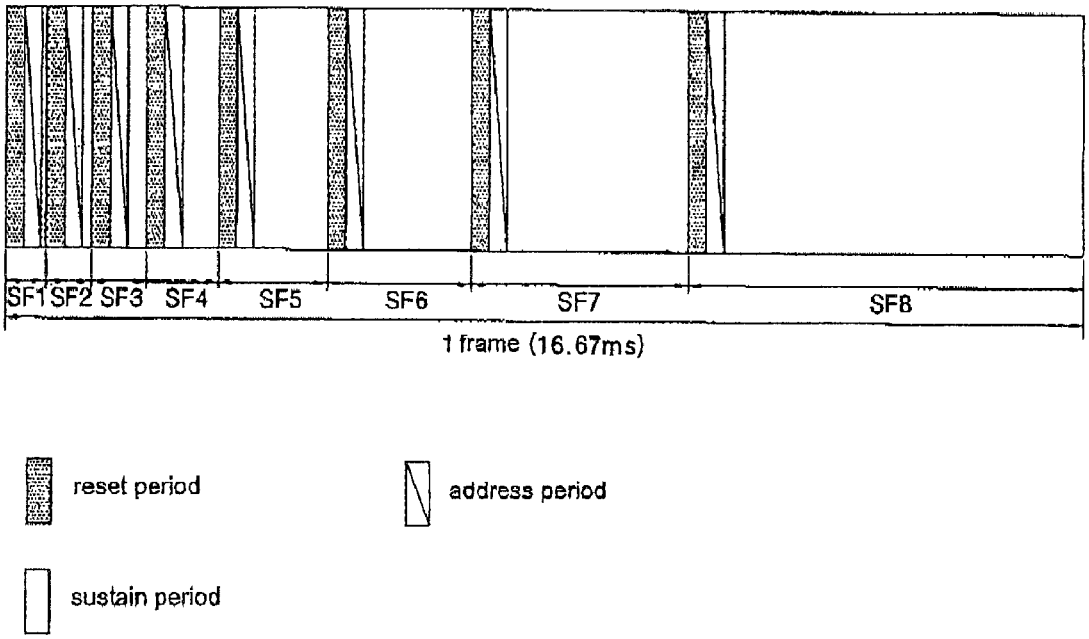
Fig. 2 Prior Art
FIG. 2 is a diagram illustrating one frame of an existing AC sheet discharge type PDP.
Figure 3:
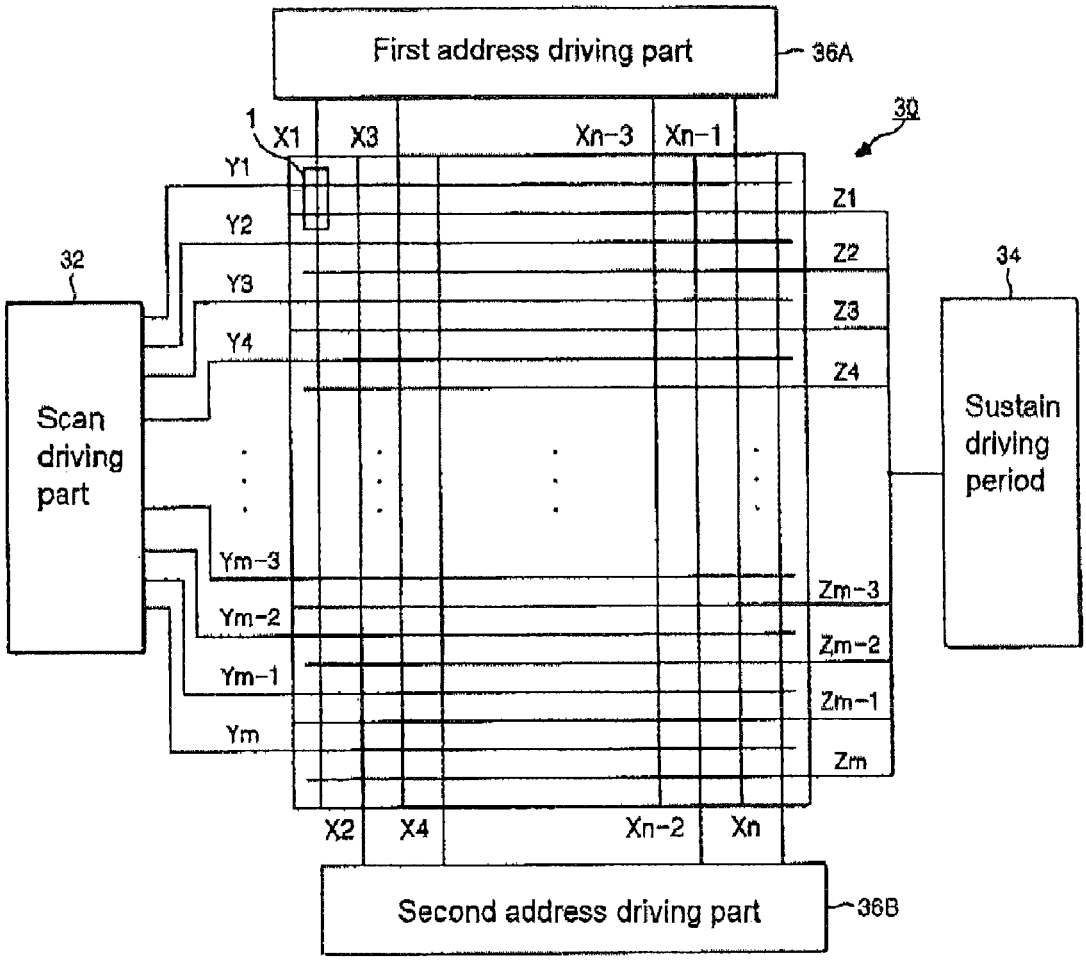
Fig. 3 Prior Art
FIG. 3 is a diagram illustrating each of driving parts that drives an existing PDP.
Figure 4:
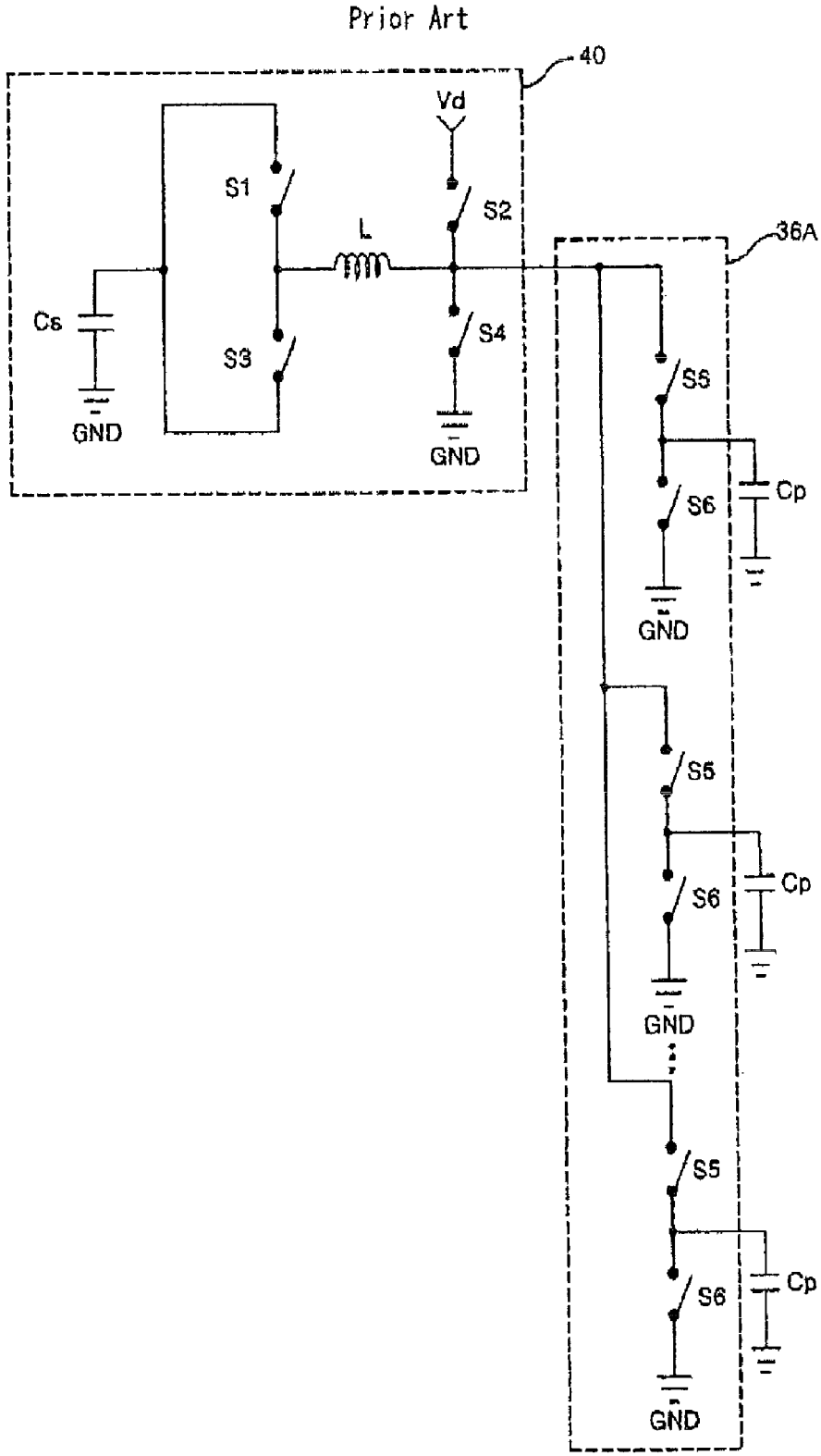
FIG. 4 is a diagram illustrating an existing electric power recovery device of PDP.
Figure 5:
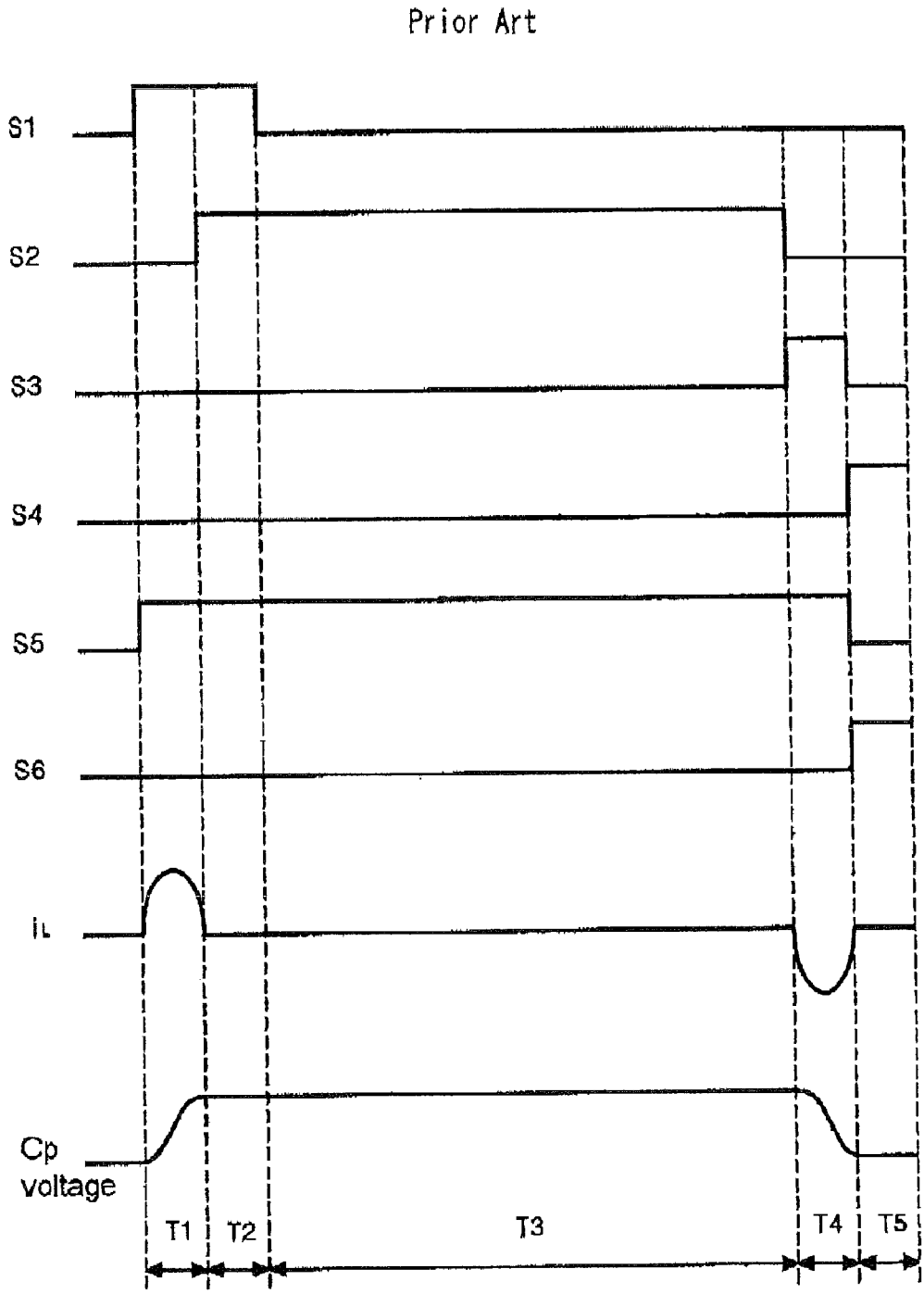
FIG. 5 is a waveform chart of an action process of an electric power recovery device illustrated in FIG. 4.
Figure 6:
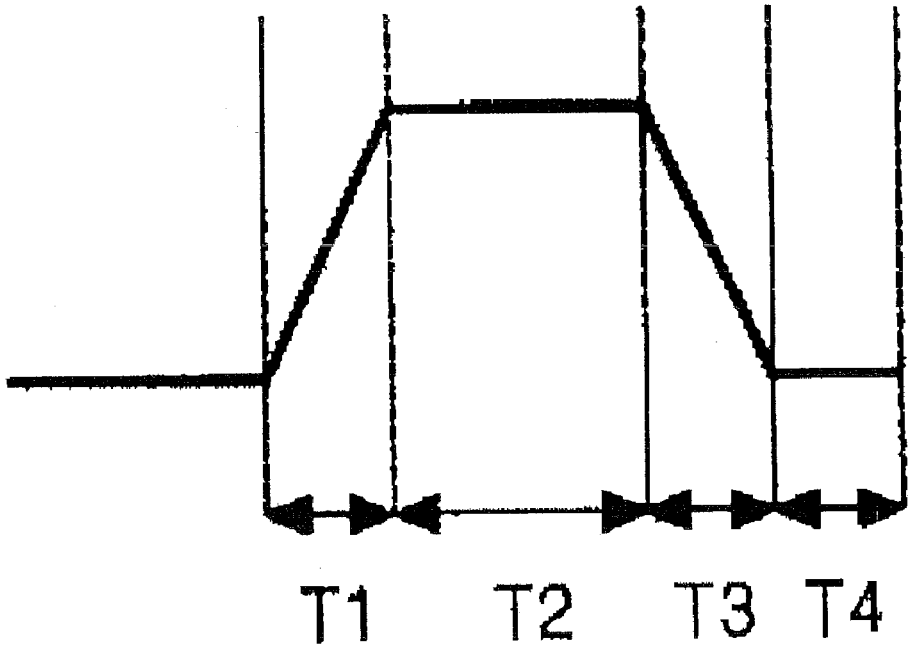
Fig. 6 Prior Art
FIG. 6 is a diagram illustrating data pulse that is provided by an electric power recovery device illustrating in FIG. 4.

To achieve the objective, the driving device of a plasma display panel in the embodiment of the present invention is comprised of a data-loading detection part that comprehends data-loading provided with each of sub-fields and generates a first control signal and a second control signal in response to the data-loading, a direct current supply part that provides direct current voltage in response to the first control signal from the data-loading detection part, an energy recovery circuit that provides data voltage in response to the second control signal from the data-loading detection part, an address driving part to generate data pulse with either direct current voltage and data voltage that are provided by the energy recovery circuit and the direct current supply part.

In the driving device of a plasma display panel in the embodiment of the present invention, the data-loading detection part generates the first control signal if a value of the data-loading is less than a predetermined standard, and otherwise the data-loading detection part generates the second control signal.

In the driving device of a plasma display panel in the embodiment of the present invention, the predetermined standard is set as half of a maximum switching frequency of the data pulse.

In the driving device of a plasma display panel in the embodiment of the present invention, the direct-current voltage supply part and said energy recovery circuit is installed on either inside or outside of said address driving part.

In the driving device of a plasma display panel in the embodiment of the present invention, the data-loading detection part is installed between a sub-field mapping part that allocates data to each of the sub-fields and the address driving part.

In the driving device of a plasma display panel in the embodiment of the present invention, the data-loading detection part is said sub-field mapping part that allocates data to each of the sub-fields.

A driving device of a plasma display panel in the embodiment of the present invention, which one frame includes at least one selective write sub-field and one selective erase sub-field, includes a sub-field mapping part that generates a first control signal in the selective erase sub-field and generates a second control signal in the selective write sub-field, a direct current voltage supply part that provides direct current voltage in response to the first control signal from the sub-field mapping part, an energy recovery circuit that provides data voltage in response to the second control signal from the sub-field mapping part, an address driving part to generate data pulse with either direct current voltage and data voltage that are provided by the energy recovery circuit and the direct-current supply part.

In the driving device of a plasma display panel in the embodiment of the present invention, the sub-field mapping part comprehends data-loading that is provided with the selective write sub-field and the selective erase sub-field respectively, and generates the first control signal if data-loading value is less than the predetermined standard and otherwise generates the second control signal.

In the driving device of a plasma display panel in the embodiment of the present invention, the standard is set as half of the maximum switching frequency of the data pulse.

In the driving device of a plasma display panel in the embodiment of the present invention, the direct current voltage supply part and the energy recovery circuit are installed on either inside or outside of the address driving part.

In the driving device of a plasma display panel in the embodiment of the present invention, the sub-field mapping part provides the first control signal in the selective erase sub-field independently to data-loading.

In the driving device of a plasma display panel in the embodiment of the present invention, the sub-field mapping part provides the second control signal in the selective write sub-field independently to the data-loading.

The driving method of a plasma display panel in the embodiment of the present invention includes a first stage wherein data loading for each of sub-field is comprehended, a second stage wherein either a direct current voltage supply part or an energy recovery circuit is driven in response to the data-loading, and a third stage wherein data pulse is generated with voltage that is provided by either the direct-current supply part or energy recovery circuit.

In the driving method of a plasma display panel in the embodiment of the present invention, a first control signal is generated in the first stage if value of the data-loading is less than predetermined standard and otherwise a second control signal is generated.

In the driving method of a plasma display panel in the embodiment of the present invention, the standard is set as half of the maximum switching frequency of the data pulse.

The explanation of the embodiment in reference to the attached diagrams reveals the objectives and aspects other than the objective described above.

Preferred embodiments of the present invention will be described in a more detailed manner with reference to the accompanying FIG. 12 to FIG. 17.

Figure 12:
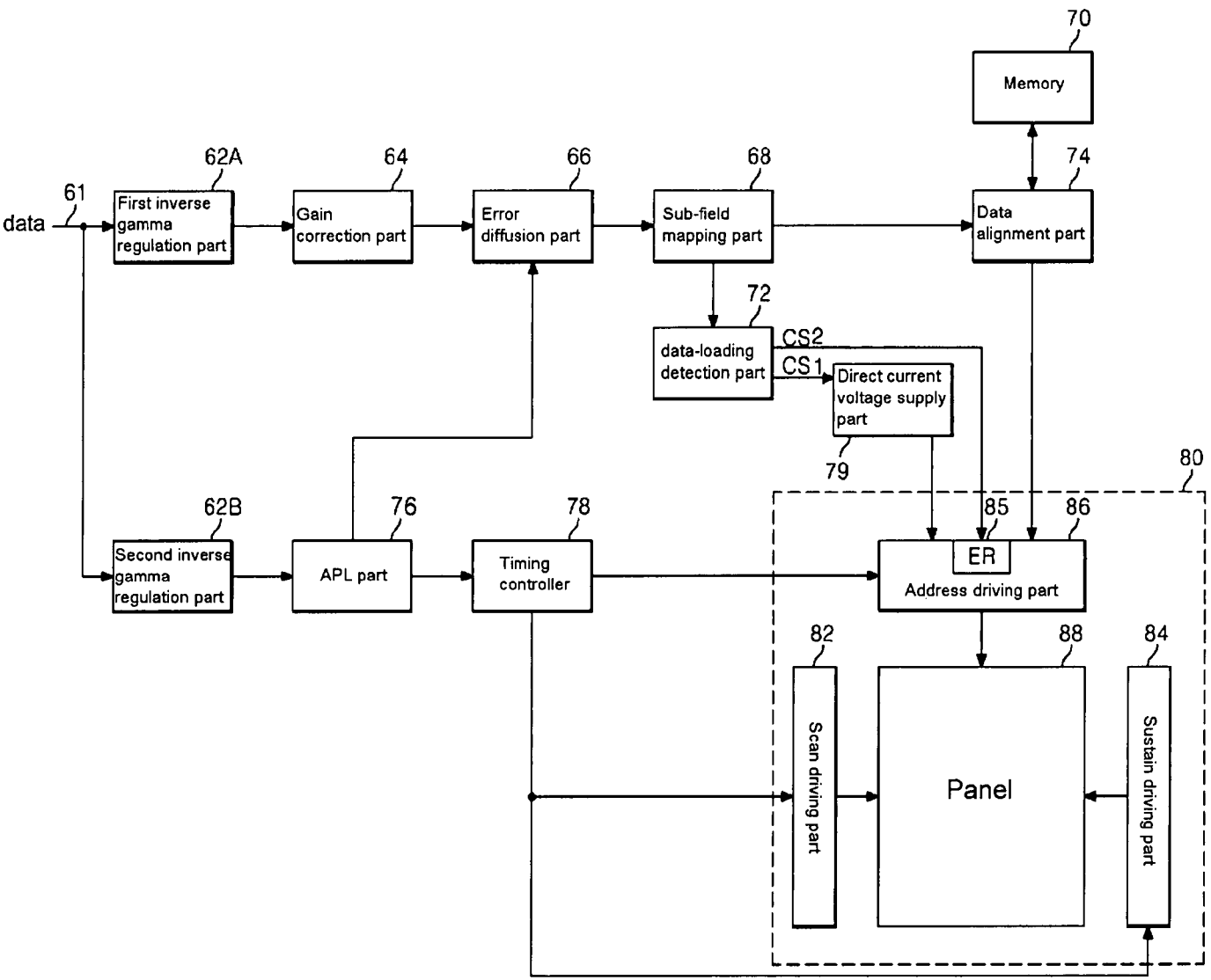
FIG. 12 is a diagram illustrating a driving device of PDP in the first embodiment of the present invention.

FIG. 12 is a diagram illustrating a driving device of PDP in the first embodiment of the present invention. Referring to FIG. 12, the driving device of PDP in the first embodiment of the present invention includes a first inverse gamma correction part 62A, a gain regulation part 64, an error diffusion part 66, a sub-field mapping part 68, and a data alignment part 74, which are connected between an input line 61 and a panel part 80, a data-loading detection part 72 and a direct current voltage supply part 79 that are connected between the sub-field mapping part 68 and the panel part 80, a second inverse gamma correction part 62B, an average picture level (hereinafter, referred to as "APL") part 76, and a timing controller 78, which are connected between the input line 61 and the panel part 80.

The first and the second inverse gamma correction parts 62A and 62B conduct the gamma correction for the video signal that gamma correction was conducted, and convert luminosity value linearly according to the gradation sequence of image signal.

The video data that was corrected by the second inverse gamma correction part 62B is input in the APL part 76, and the APL part 76 generates N-stage signal to regulate the number of sustain pulses. On the other hand, the APL that is detected by the APL part 76 is input into the timing controller 78.

The gain regulation part 64 amplifies the video data that is corrected in the first inverse gamma correction part 62A.

The error diffusion part 66 finely regulates the luminosity value by diffusing error components of the cells into each of the adjacent cells.

The sub-field mapping part 68 reallocates the video data that is corrected in the error diffusion part 66 to each of the sub-fields.

The data alignment 74 converts the video data that is input from the sub-field mapping part 68 so that the vide data can fit in the resolution format and stores it in the memory 70, and also retrieves the data that is stored in the memory 70 and provides it with the address driving part 86 in the panel part 80.

The data-loading detection part 72 detects the switching rate of data that is reallocated to each of the sub-fields by the sub-field mapping part 68, in other words, data-loading. Then, the data-loading detection part 72 provides the control signal CS1 to the direct current voltage supply part 79 or provides the control signal CS2 to the electric power recovery device 85 in the address driving part 86 in response to the data-loading that is detected.

The direct current supply part 79 is driven by first control signal CS1 that is provided by the data-loading part 72, and provides direct current voltage to the address driving part 86. The direct current voltage supply part 79 provides the direct voltage to the address driving part 86 when there are few data-loadings that are detected by the data-loading detection part 72, and turns on the relevant switch that is connected to each of the data electrode lines. At this time, the direct current voltage supply part 79 can be installed in the address driving part 86.

The timing controller 78 is connected between the APL part 76 and the panel part 80, regulates the number of sustain pulses by controlling the circuit that generates sustain pulses with the APL.

The panel part 80 includes the panel 88 that displays an image and some driving parts that drive each of a scan electrode, a sustain electrode, and an address electrode respectively. The driving parts include the scan driving part 82, the sustain driving part 84, and the address driving part 86, which drive each of the electrodes. Here, each of the driving parts is driven by the timing control signal that is output from the timing controller 78. Also, the scan driving part 82 and the sustain driving part 84 provide sustain pulses, which generate display discharge by the timing controller 78 in the sustain period, to the scan electrode and the sustain electrode. The electric power recovery device 85 to lower power consumption is installed in the address driving part 86 that is in the panel part 80.

Figure 7:
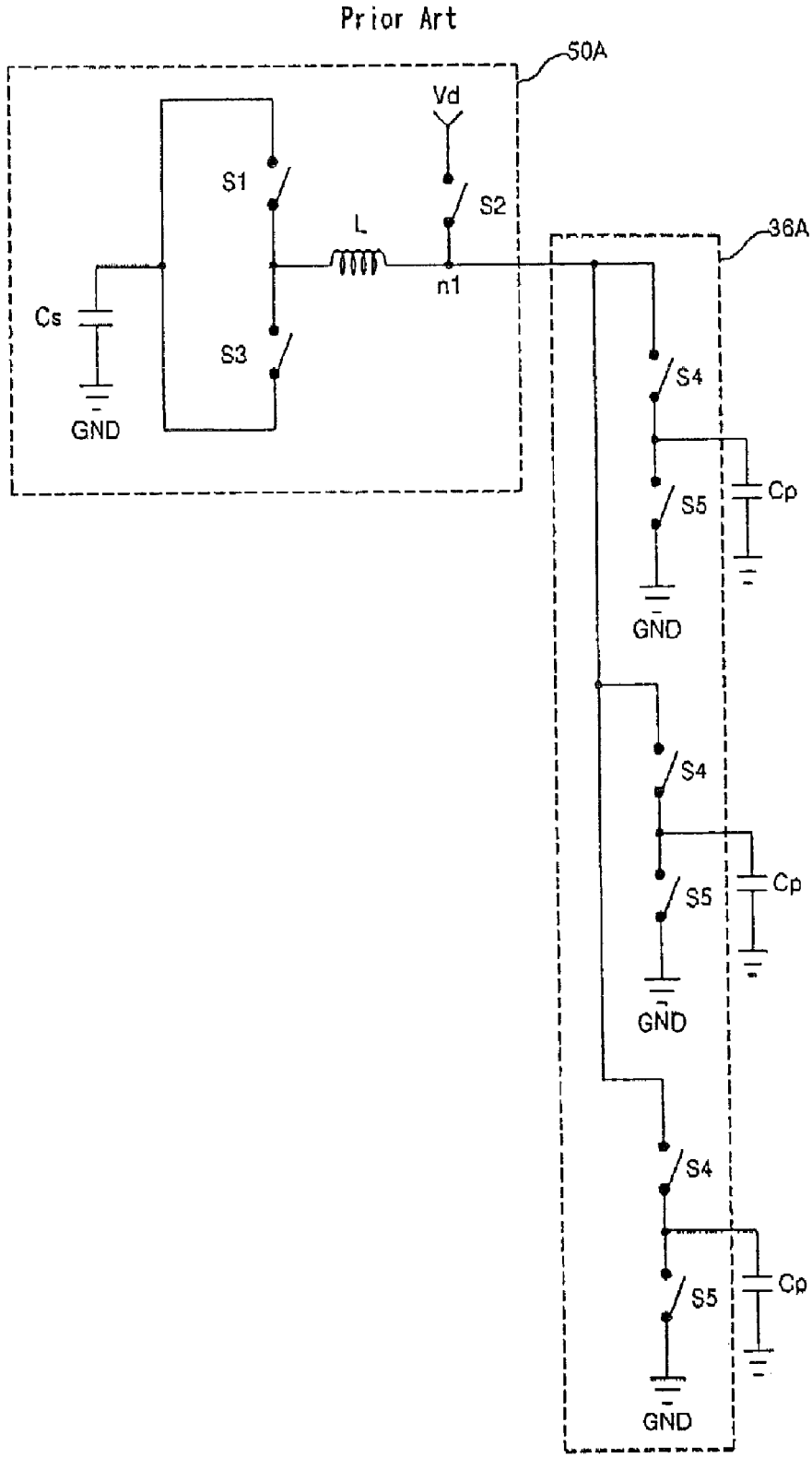
FIG. 7 is a diagram illustrating an existing electric power recovery device of PDP in another embodiment.
Figure 8:
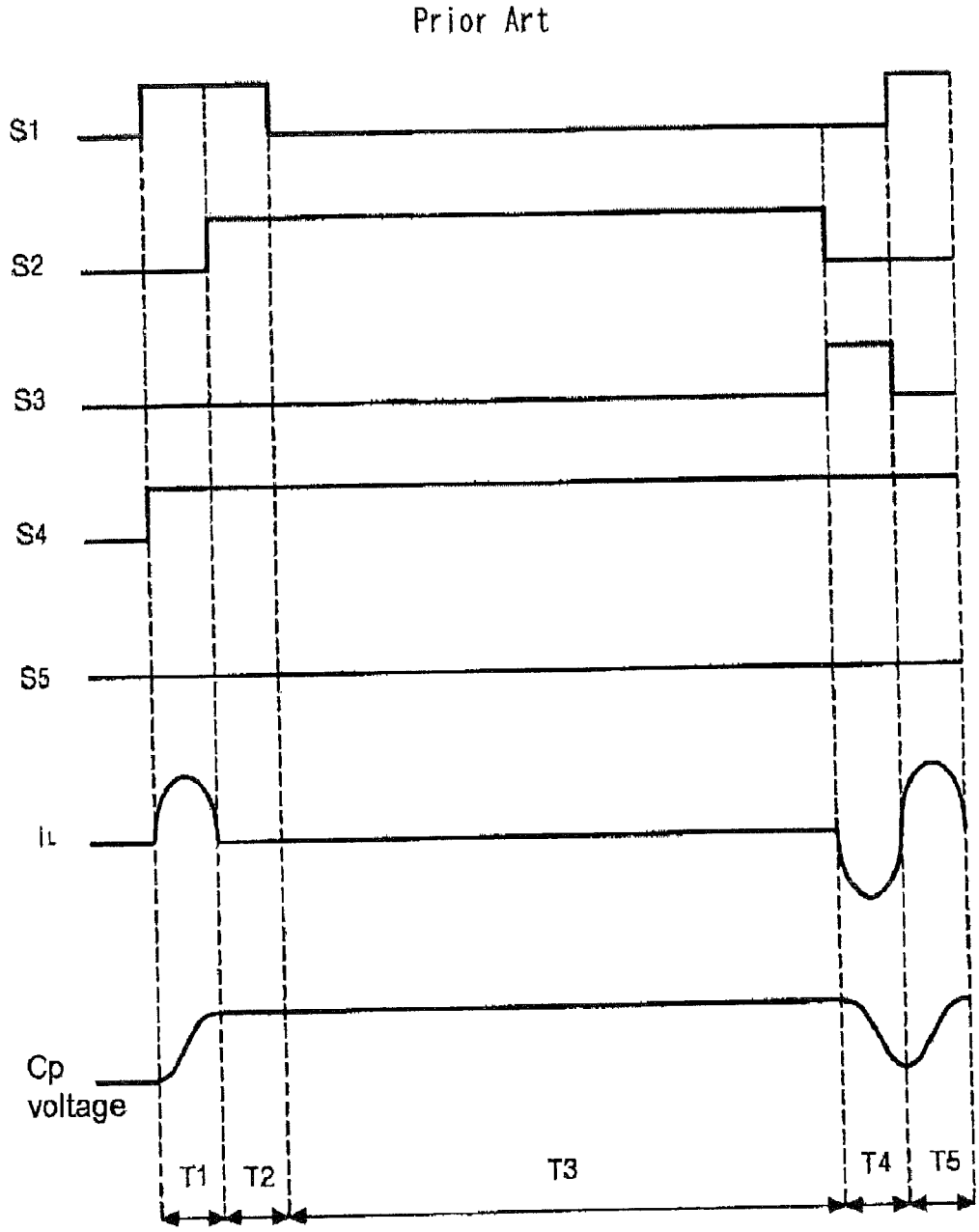
FIG. 8 is a waveform chart illustrating an action process of an electric power recovery device illustrated in FIG. 7.
Figure 9:
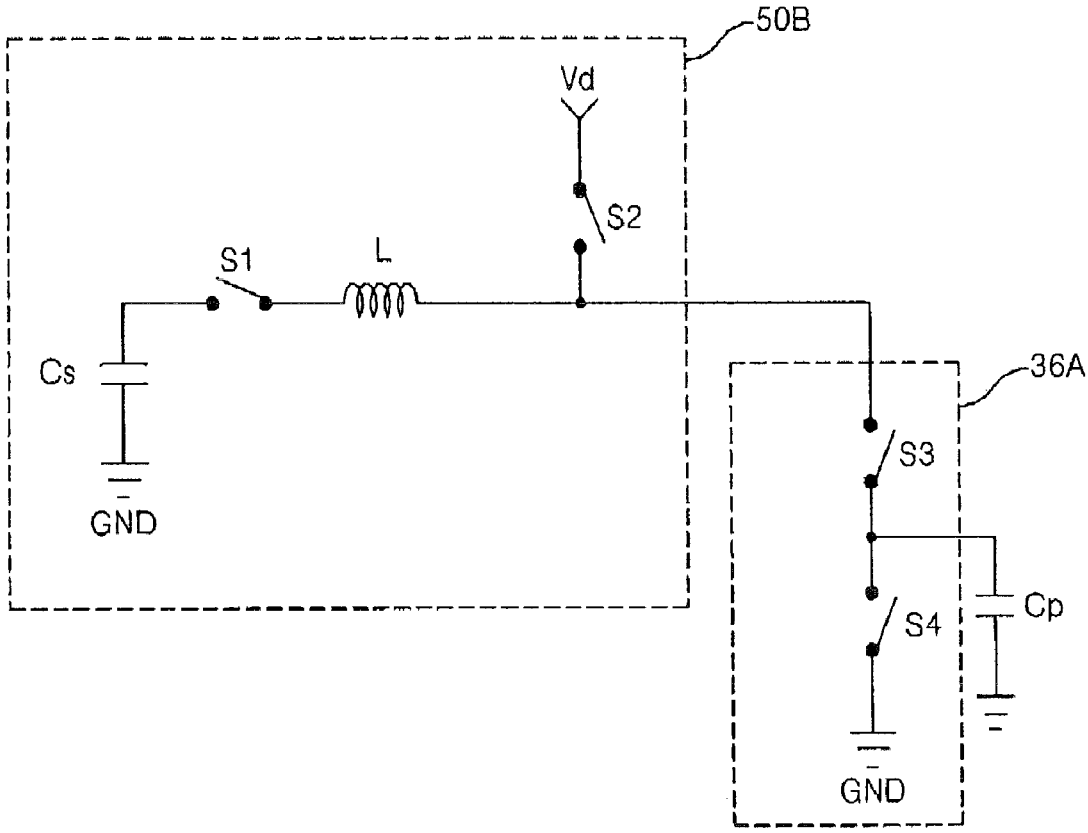
Fig. 9 Prior Art
FIG. 9 is a diagram illustrating an existing electric power recovery device of PDP in another embodiment.
Figure 10:
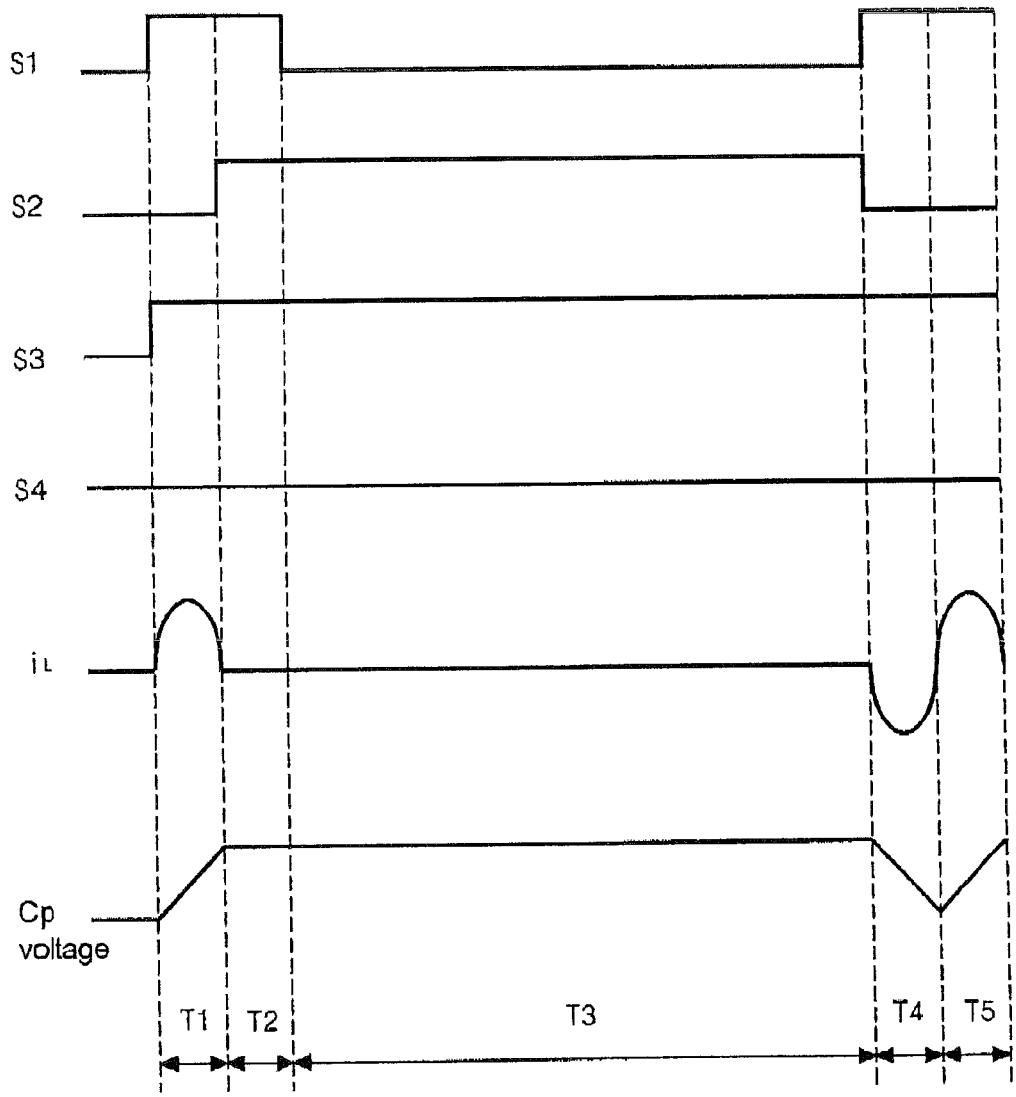
Fig. 10 Prior Art
FIG. 10 is a waveform chart illustrating an action process of an electric power recovery device illustrated in FIG. 9.
Figure 11:
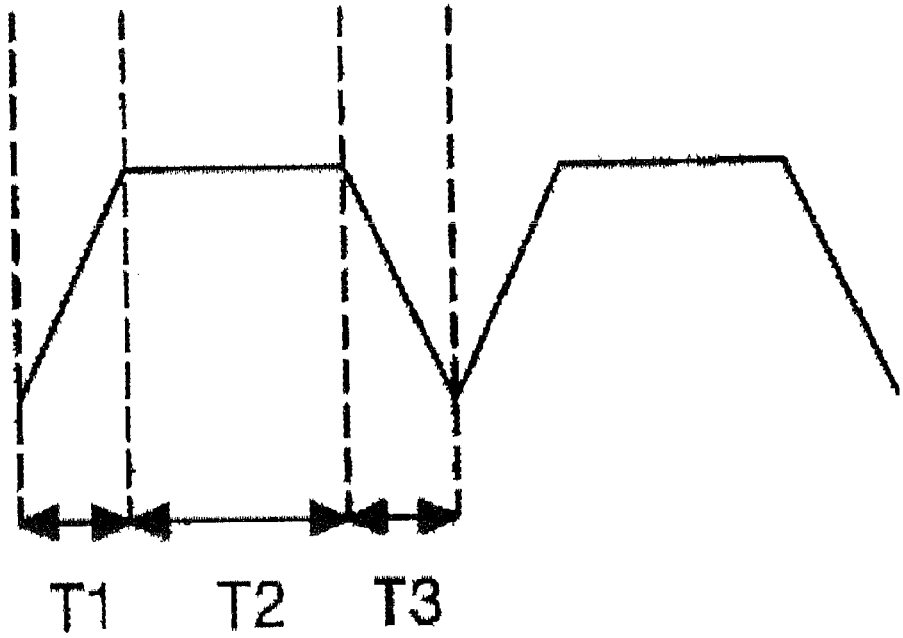
Fig. 11 Prior Art
FIG. 11 is a diagram illustrating data pulse provided by an electric power recovery devices illustrated in FIGS. 7 and 9.

The electric power recovery device 85 is driven by the second control signal CS2 that is provided by the data-loading detection part 72. If there are a large number of data-loading, in other words, if the second control signal CS2 is provided, the electric power recovery device 85 provides data pulse to each of the data electrode lines that are in the panel 88 by a switching action. At this time, the electric power recovery device 85 uses the electric power recovery device illustrated in FIGS. 7 and 9. Therefore, it is possible for the electric power recovery device 85 to not only lower the power consumption by the recovery of the power, but also to execute the high-speed addressing.

Figure 13:
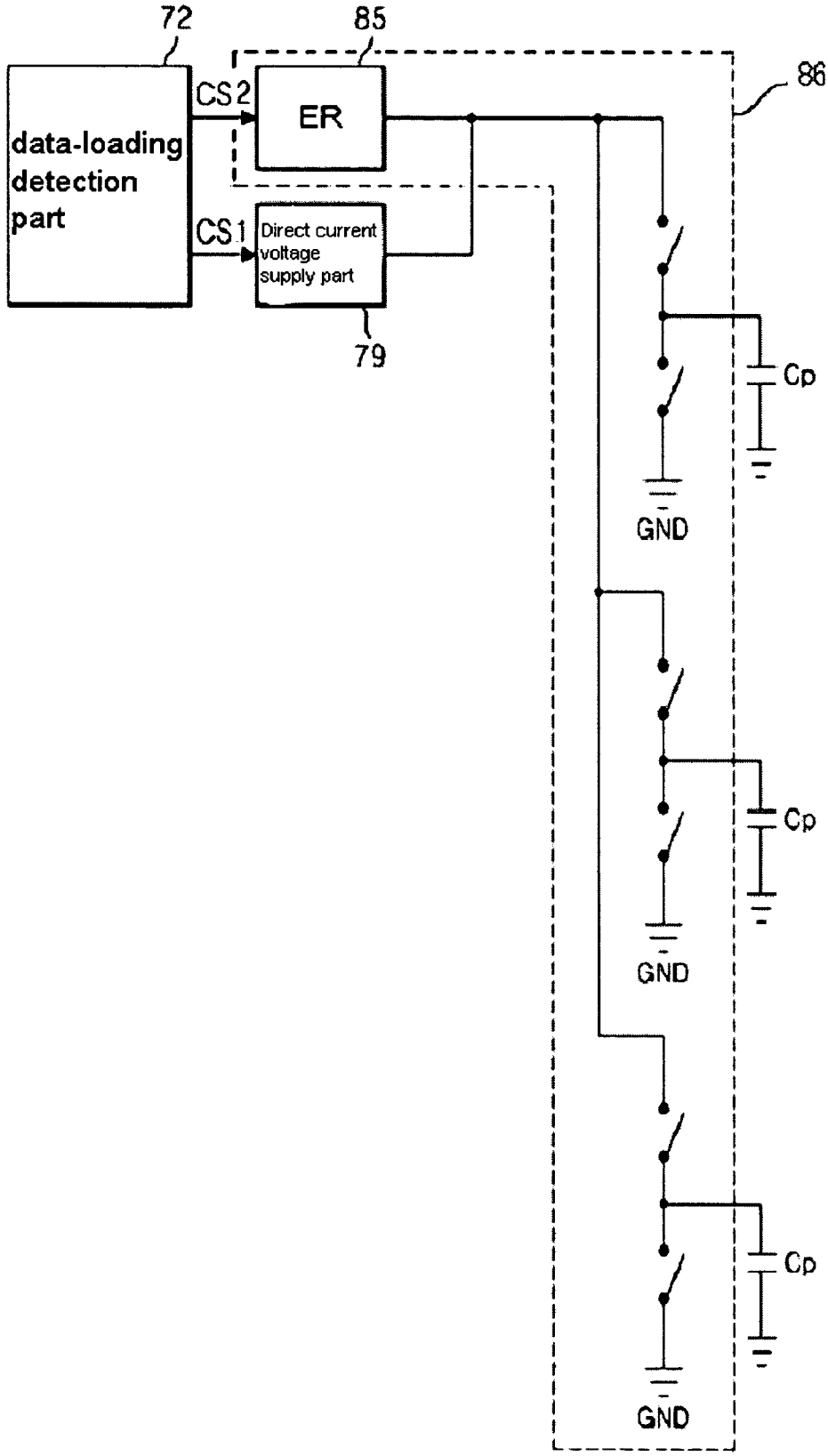
FIG. 13 is a diagram illustrating a driving device of PDP illustrated in FIG. 12 in detail.

This is now explained in detail in reference to FIG. 13. Firstly, the data-loading detection part 72 drives the electric power recovery device 85 by providing the second control signal CS2 to the address driving part 86 in the panel 80, if the data-loading value is greater than or equal to the standard. If the data-loading value is less than the standard, the data-loading detection part 72 drives the direct current supply part 79 by providing the first control signal CS1 to the direct current voltage supply part 79 that is connected to the address driving part 86 in the panel part 80. At this time, to lower power consumption, either the direct current supply part 79 or the electric power recovery device 85 is driven by generating different control signals by the data-loading. That is, the data-loading value being greater than or equal to the standard means that there is a large number of data pulses that must be provided to each of the data electrode lines. In this case, the electric power recovery device 85 in the address driving part 86 is driven by providing the second control signal CS2 to the address driving part 89. Power consumption may be lowered because power recovered by the electric power recovery device 85 is used to provide the next data pulse.

On the other hand, the data-loading value being at the level of the standard means that there are few data pulses that must be provided to each of the data electrode lines. In this case, if the electric power recovery device 85 in the address driving part 86 is driven, the power consumption to drive each of the switching elements is larger than the power that is recovered by the electric power recovery device 85. Accordingly, the power consumption is increased even if the electric power recovery device 85 is driven to recover power. Therefore, the direct current supply part 79 is driven by providing the first control signal CS1, without driving the electric power recovery device 85, if the data-loading value is less than the standard. If the direct current voltage supply part 79 is driven, the switch connected to each of the relevant data electrode lines is turned on, so that data pulse can be provided to each of the data electrode lines by providing the direct current to the address driving part 86. Accordingly, the power consumption is lowered because the electric power recovery device is not driven and the data pulse is provided to each of the data electrode lines.

The setting method of the data-loading standard that is set so that the data-loading detection part 72 can generate either of the first control signal CS1 or the second control signal CS2 is now explained with an example of the video standard of video graphics array (VGA) with a total of 480 data lines. In 480 data lines, the maximum switching frequency of data pulse is 240. Accordingly, the standard for the data-loading value becomes 120, which corresponds to half of the maximum switching frequency. That is, in the case of the VGA, if the switching frequency is less than 120, the data-loading detection part 72 provides the first control signal CS1 to the direct current supply part 79 that is connected to the address driving part 86 in the panel part 80, and comes to drive the direct current voltage supply part 79. Accordingly, power consumption is lowered. If the switching frequency is more than 120, the data-loading detection part 72 provides the second control signal CS2 to the address driving part 86 in the panel part 80, and drives the electric power recovery device 85. Accordingly, power consumption is lowered.

Figure 14:
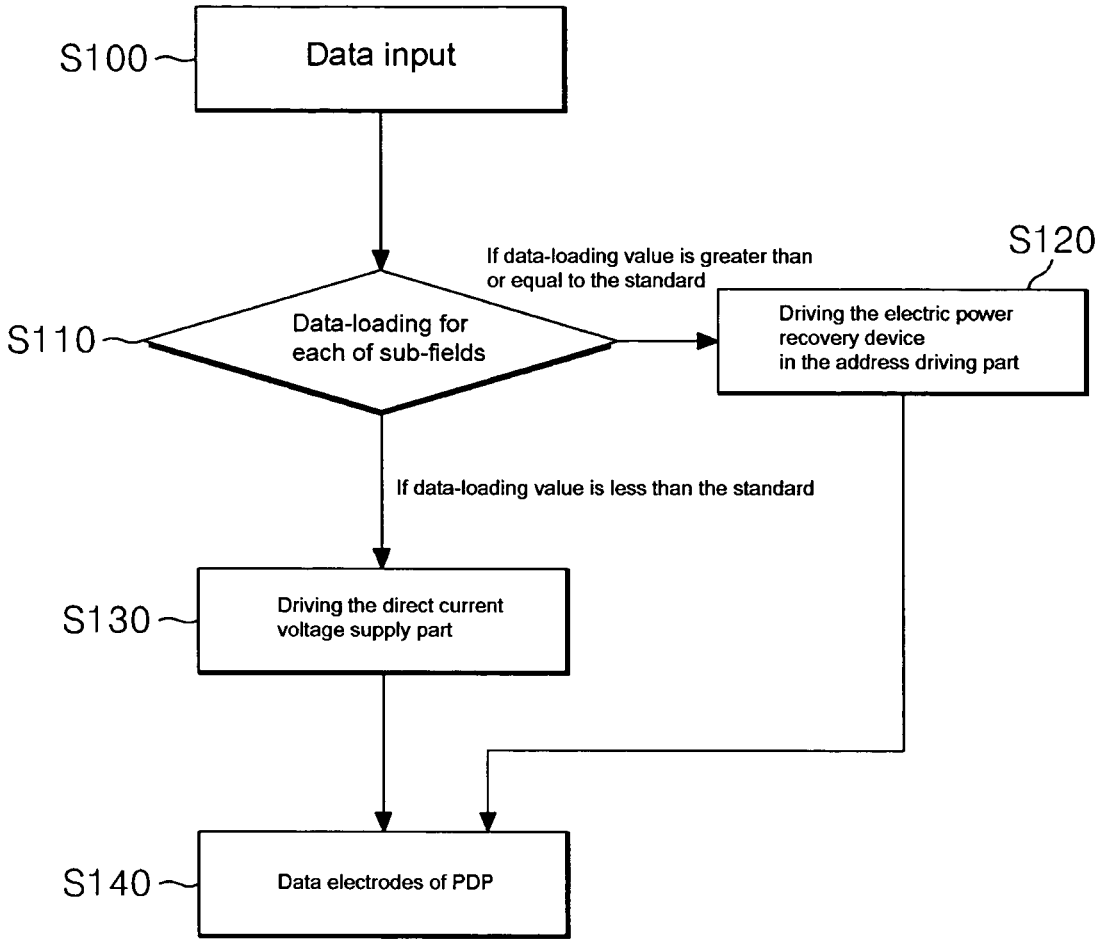
FIG. 14 is a flow chart illustrating a driving method of a driving device of PDP illustrated in FIG. 12.

The driving method of PDP in the first embodiment of the present invention is now explained with reference to FIG. 14. Firstly, in a step S100, the data that is reallocated to each of the sub-fields is provided to the data-loading detection part 72. In a step S110, data-loading for each of sub-fields is detected in the data-loading detection part 72, and if the data-loading value is less than the standard, the first control signal CS1 is provided to the direct current voltage supply part 79, and if the data-loading value is greater than or equal to the standard, the second control signal CS2 is provided to the address driving part 86 in the panel part 80. In a step S120, if the data-loading value becomes greater than or equal to the standard, the second control signal CS2 is provided to the address driving part 86 in the panel part 80, and the electric power recovery device 85 is driven. Accordingly, power consumption can be lowered because power is recovered by the electric power recovery device 85 and is used in providing the next data pulse, when the data pulse is provided to each of the data electrode lines. At this time, it is possible for the electric power recovery device 85 to not only recover power and lower the power consumption, but also to execute the high-speed addressing because the electric power recovery device 85 uses the electric power recovery device illustrated in FIGS. 7 and 9. In a step S130, if data-loading value is less than the standard, the first control signal CS1 is provided to the direct current voltage supply part 79, and the direct current voltage supply part 79 is driven so that data can be provided to each of the data electrode lines by a switching action. Accordingly, the electric power recovery device 85 is not driven and power to drive each of its switching components (not shown in the diagram) is not consumed. Therefore, power consumption can be lowered. In a step S140, data pulse is provided to each of the data electrode lines of the PDP by the control of the steps S120 and S130.

Figure 15:
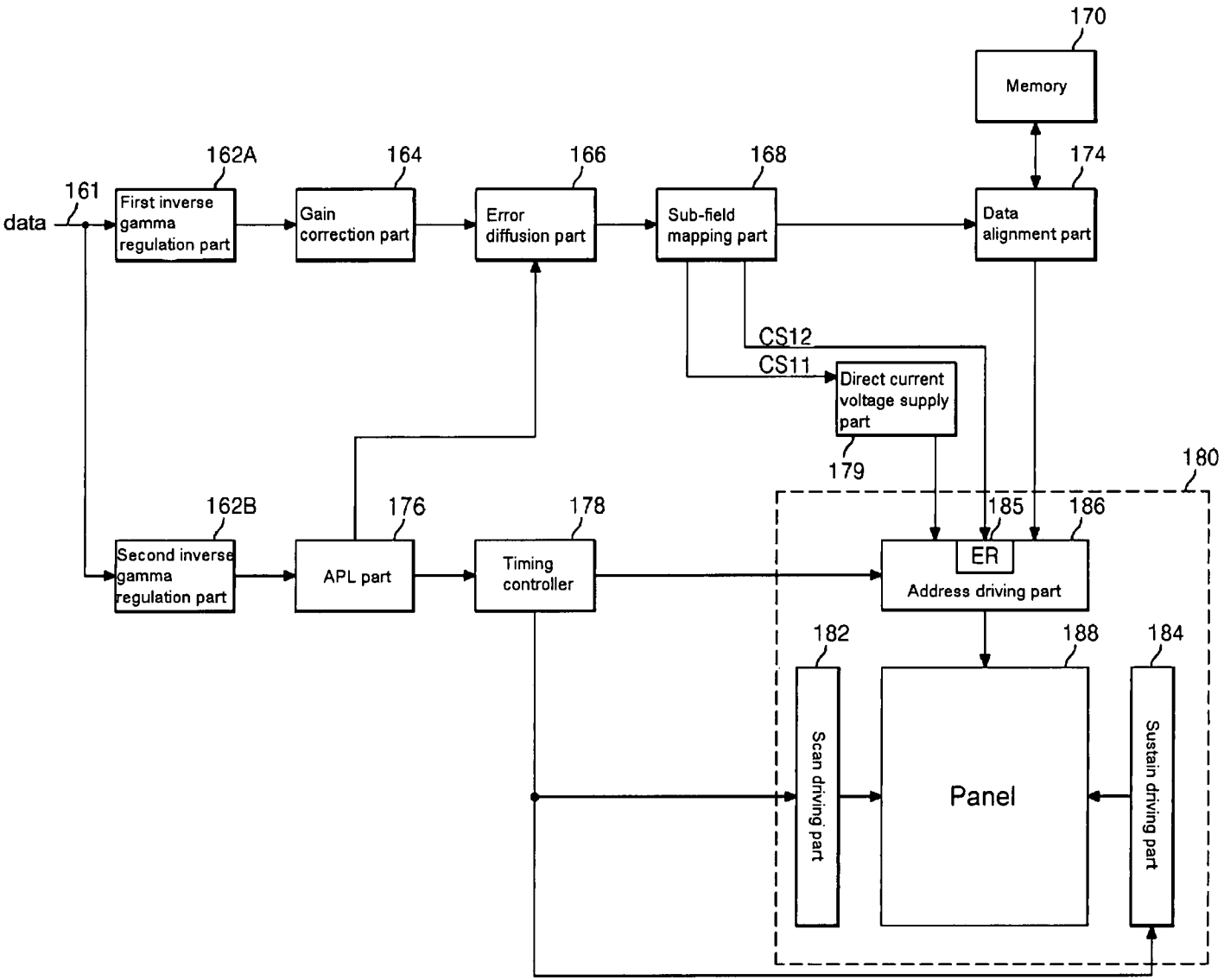
FIG. 15 is a diagram illustrating a driving device of PDP in the second embodiment of the present invention.

FIG. 15 is a diagram illustrating a driving device of PDP in the second embodiment of the present invention. Referring to FIG. 15, the driving device of PDP in the second embodiment of the present invention is different from that in the first embodiment of the present invention in that the data-loading detection part is removed in the driving device of PDP in the second embodiment. That is, the other components of the driving devices of PDP in the first and second embodiments are the same.

Video data that is corrected by a second inverse gamma correction part 162B is input in an APL part 176, and the APL part 176 generates N-stage signal to regulate the number of sustain pulse. On the other hand, the APL that is detected by the APL part 176 is input in the timing controller 178.

A gain regulation part 164 amplifies the video data that is corrected in the first inverse gamma correction part 162A by the effective gain.

An error diffusion part 166 finely regulates the luminosity value by diffusing error components into adjacent cells.

A sub-field mapping part 168 reallocates video data that is corrected in the error diffusion part 166 to each of the sub-fields. In the sub-field mapping part 168, whether provided data is driven by a selective write (hereinafter, referred to as "SW") method or the selective erase (hereinafter, referred to as "SE") method is judged. A control signal CS11 is provided to the direct current supply part 179 or a control signal C12 is provided to electric power recovery device 185 that is installed in the address driving part 186 in the panel part 180.

The direct current voltage supply part 179 is driven by an eleventh control signal CS11 that is provided by the sub-field mapping part 168, and direct current is provided to the address driving part 186 in the panel part 180. When the input data is driven in the SE method, the direct current voltage supply part 179 provides direct current to the address driving part 186, and turns on the switch that is connected to each of the relevant data electrode lines so that data pulse is provided to each of the electrode lines. Here, the direct current voltage supply part 179 can be installed in the address driving part 186.

A data alignment part 174 converts video data that is input from the sub-field mapping part 168, so that it can fit in the resolution format in the panel 188, and stores it in a memory 170. The data alignment also reads out the data that is stored in the memory 170 and provides it with the address driving part 186 in the panel part 180.

The timing controller 178 is connected between the APL part 176 and the panel part 180, and regulates the number of sustain pulses by controlling the circuit that generates the sustain pulse with APL.

The panel part 180 includes a panel 188 that displays an image, and some driving parts to drive each of a scan electrode, a sustain electrode, and an address electrode in the panel 188. The driving parts include a scan driving part 182, a sustain driving part 184, and an address driving part 186 to drive each of electrodes. Here, each of the driving parts is driven by timing control signal from the timing controller 178. Also, the scan driving part 182 and the sustain driving part 184 provide sustain pulse, which generates display discharge by the control of the timing controller 178 during the sustain period, with the scan electrode and the sustain electrode. The electric power recovery device 185 to lower power consumption is installed in the address driving part 186 in the panel part 180.

The electric power recovery device 185 is driven by a twelfth control signal S12 that is provided by the sub-field mapping part 168. When input data is driven in the SW method, the electric power recovery device 185 provides data with each of the data electrode lines in the panel 188 by a switching action. Here, it is possible for the electric power recovery device 185 not only to recover power and lower power consumption, but also to execute the high-speed addressing, because the electric power recovery device 185 applies the electric power recovery devices illustrated in FIGS. 7 and 9.

Figure 16:
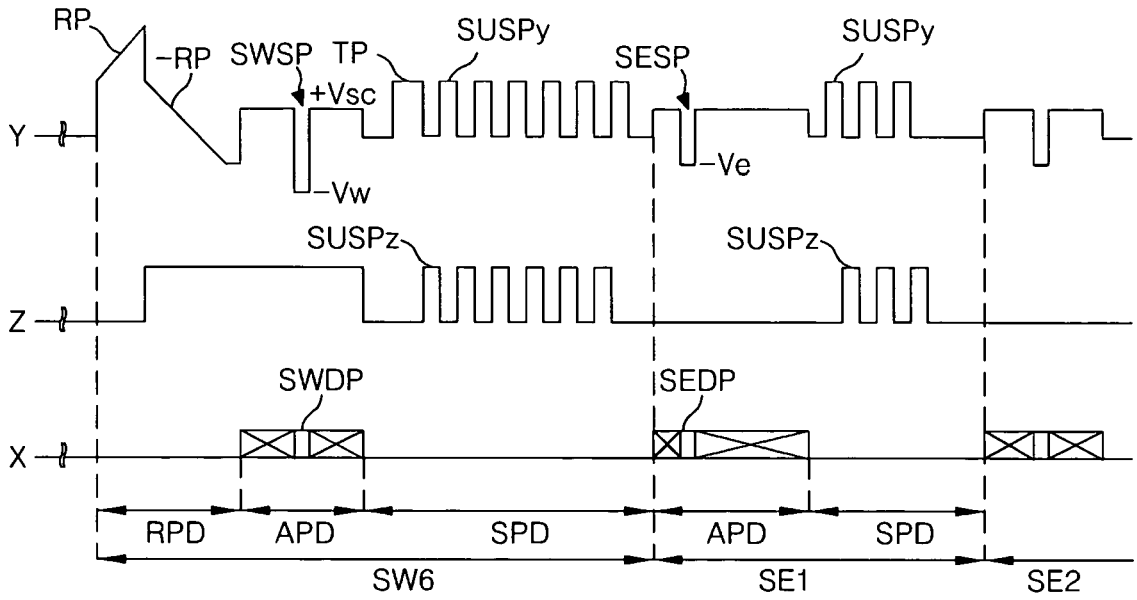
FIG. 16 is a driving waveform of a selective write system and a selective erase system used in a driving device of PDP illustrated in FIG. 15.

FIG. 16 is a chart illustrating the waveform by the selective write selective erase (hereinafter, referred to as "SWSE") driving method used in the second embodiment of the present invention.

Referring to FIG. 16, in the reset period RPD in the selective write sub-field, a reset pulse RP that has a set-up waveform is provided with scan electrode lines Y, and then a reset pulse -RP that has a set-down waveform is provided with scan electrode lines Y. Furthermore, direct current voltage with positive polarity is provided with sustain electrode lines Z.

In the address period APD of the selective write sub-field, while direct current with positive polarity is provided to the sustain electrode lines Z, the selective write scan pulse (hereinafter, referred to as "SWSP") with negative polarity and the selective write data pulse (hereinafter, referred to as "SWDP" with positive polarity are provided to the scan electrode lines Y or the address electrode lines X, so that the SWSP and the SWDP are synchronized with each other. The sustain pulses SUSPy and SUSPz are alternately provided to the scan electrode lines Y and the sustain electrode lines Z, so that sustain discharge is generated for the cells that are lit by the address discharge in the selective write sub-field. And, at the end of each of the selective write sub-fields, an erase pulse (not shown in the diagram) that erases the sustain discharge is provided to the sustain electrode lines Z.

The reset period RPD in the selective erase sub-field is omitted. In the address period APD in the selective erase sub-field ESF, the selective erase scan pulse (hereinafter, referred to as "SESP") with negative polarity and the selective erase data pulse (hereinafter, referred to as "SEDP") with positive polarity that light out the cells are provided to each of the scan electrode lines Y and the address electrode lines X so that the SESP and the SEDP are synchronized with each other. A voltage value of the SESP falls to the selective erase scan voltage Ve with negative polarity, which is higher than the scan standard voltage Vw with negative polarity. For each of the cells that is not lit out by the address discharge in the selective erase sub-field, the sustain pulses SUSPy and SUSPz are alternately provided to the scan electrode lines Y and the sustain electrode lines Z so that the sustain discharge is generated. If the following sub-field is the selective erase field, the SUSPy with relatively wide range of pulse is provided to each of the scan electrode lines Y at the end of the present selective erase sub-field. And, in the last selective erase sub-field that the next sub-field is selective write sub-field, an erase pulse and a ramp signal, which are not shown in each of the scan electrode lines Y and the sustain electrode lines Z, are provided, and the sustain discharge in each of the lit cells is erased.

If the input data by the SWSE method is driven by the SE method, the eleventh control signal CS11 is provided with the direct current voltage supply part 179 that is connected to the address driving part 186 in the panel part 180 from the sub-field mapping part 168, and the direct current voltage supply part 179 is driven. If the input data is driven by the SW method, the twelfth control signal CS12 is provided with the address driving part 186 in the panel part 180 from the sub-field mapping part 168, and the electric power recovery device 185 is driven. At this time, to lower power consumption, either the direct current voltage supply part 179 or the electric power recovery device 185 is driven, by generating different control signals according to the SW driving method and the SE driving method. That is, the SWSE is normally comprised of six SW sub-fields and six SE sub-fields, in other words, a total of 12 sub-fields. At this time, the number of sub-fields comprising of the SWSE can be varied. Here, the SW drives six sub-fields independently. That is, each of the cells generates independent data pulse in six sub-fields, and realizes the gradation sequence. By the way, when the SE is driven, the cells that are once lit out do not generate more data pulse in the following sub-fields. That is, in the SE period, the data pulse is only once required for the cell that is lit. Accordingly, the data-loading in the SW period is much larger than that in the SE period. Therefore, in the SW period with a large data loading, the twelfth control signal CS12 is provided with the address driving part 189, and the electric power recovery device 185 in the address driving part 186 is driven. Power that is recovered by the electric power recovery device 185 is used to provide the next data pulse, and accordingly power consumption comes to be lowered. And, the direct current voltage supply part 179 is driven by providing the eleventh control signal CS11 in the SE period with the small data-loading. When the direct current voltage supply part 179 is driven, the direct current is provided with the address driving part 186, and the switch, which is connected to each of the relevant data electrode lines, is turned on, so that data pulse can be provided with each of the data electrode lines. Accordingly, the data pulse is provided with each of the data electrode lines without driving the electric power recovery device, and power consumption is lowered.

Figure 17:
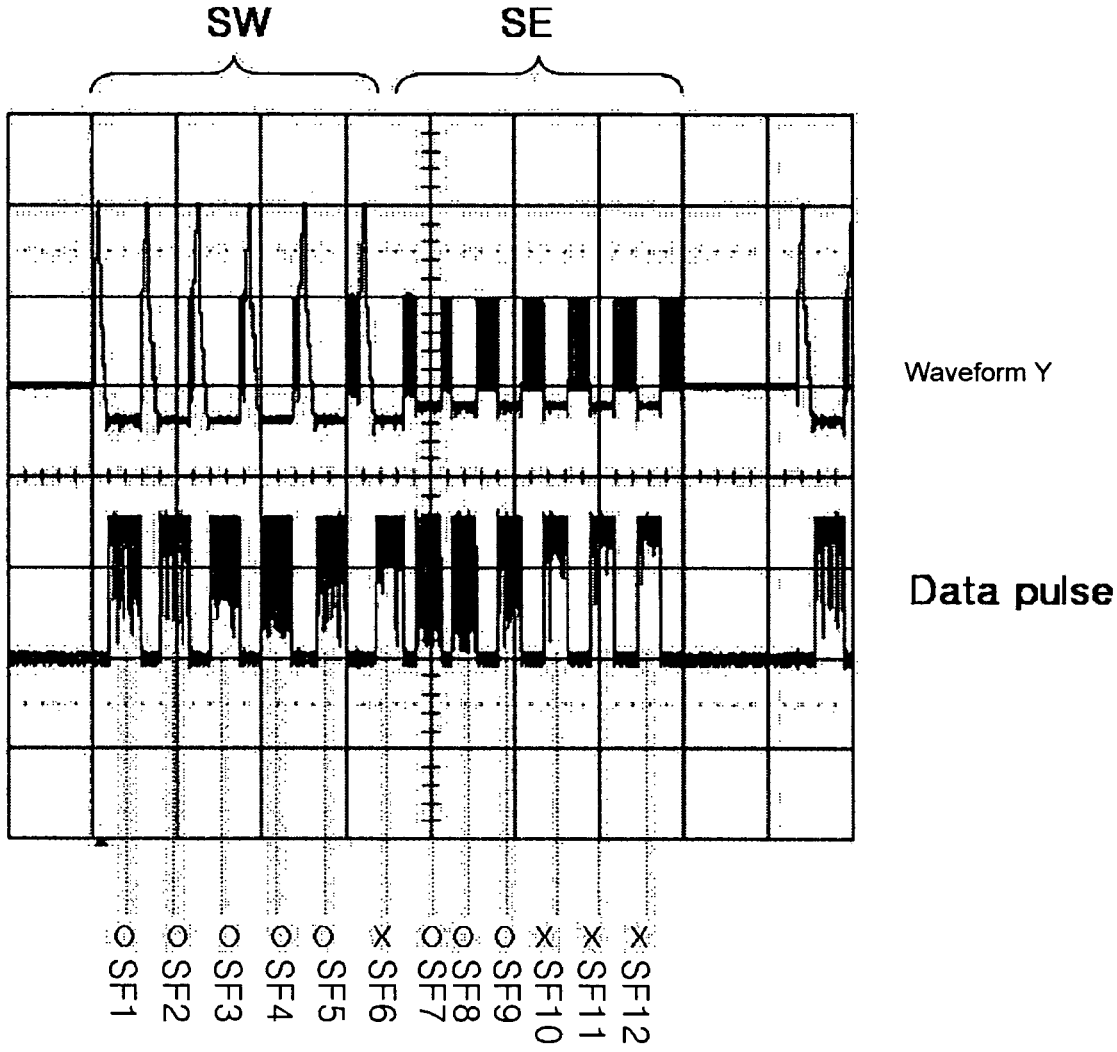
FIG. 17 is a waveform of data-loading in a selective write sub-field and a selective erase sub-field.

FIG. 17 is a waveform chart illustrating the data-loading in the selective write sub-field and the selective erase sub-field. In the experiment that FIG. 17 is obtained, data pulse is provided with each of the data electrode lines with the use of different devices, according to whether the input data in the second embodiment of the present invention is driven by the SW method or is driven by the SE method. That is, in the SW period with the large data-loading, the electric power recovery device 185 was driven, and in the SE period with the small data-loading, the electric power recovery device 185 was not driven. If the first embodiment of the present invention is applied here, and in the sub-field with relatively small data-loading in the SW period, for example, in the sixth sub-field SF6 as is illustrated in FIG. 17, the direct current voltage supply part is driven without driving the electric power recovery device, power consumption can be lowered. Also, in the sub-field with relatively large data-loading in the SE period, for example, as is shown in FIG. 17, in the seventh through ninth sub-fields SF7 though SF9, power consumption can be lowered by driving the electric power recovery device 185. Here, the sub-fields with many parts displayed in black have large data-loading, and the other sub-fields have small data-loading.

The driving device and the driving method of a plasma display panel of the present invention upgrade driving efficiency, because an electric power recovery device can be driven with the distinction of driving and non-driving according to the data-loading of video data that is input and the drive method. The driving device and the driving method of a plasma display panel of the present invention enables high-speed driving by the use of an electric power recovery device that can execute the high-speed driving.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving device of a plasma display panel comprising:

a data-loading detection part for generating a first control signal and a second control signal in response to a data-loading of a sub-field;

a direct current supply part for providing a direct current voltage, in response to the first control signal, to an address driving part; and an energy recovery circuit for providing a data signal in response to the second control signal to the address driving part, wherein the address driving part applies the direct current voltage to a data electrode line when a value of the data-loading is less than half of a maximum switching frequency of a data pulse applied to the data electrode line, and the address driving part applies the data signal to the data electrode line when the value of the data-loading is equal to or greater than half of the maximum switching frequency of the data pulse.

2. The driving device of a plasma display panel according to claim 1, wherein the direct current supply part and the energy recovery circuit are installed on either an inside or an outside of the address driving part.

3. The driving device of a plasma display panel according to claim 1, wherein the data-loading detection part is installed between a sub-field mapping part that allocates a data to each of the sub-fields and the address driving part.

4. The driving device of a plasma display panel according to claim 3, wherein the data-loading detection part includes the sub-field mapping part that allocates the data to each of the sub-fields.

5. A driving device of a plasma display panel for displaying an image in a frame having at least one selective write sub-field and one selective erase sub-field, the driving device comprising:

an energy recovery circuit;

a direct current voltage supply part for providing a direct current voltage; and an address driving part for applying a data signal generated from the direct current voltage without using the energy recovery circuit to a data electrode line during the selective erase sub-field, and the address driving part applying the data signal generated from using the energy recovery circuit to the data electrode line during the selective write sub-field.

6. The driving device of a plasma display panel according to claim 5, wherein the direct current voltage supply part and the energy recovery circuit are installed on either an inside or an outside of the address driving part.

7. The driving device of a plasma display panel according to claim 5, wherein a value of the data-loading of the selective erase sub-field is less than a value of the data-loading of the selective write sub-field.

8. A driving device of a plasma display panel for displaying an image in a frame having at least one selective write sub-field and one selective erase sub-field, the driving device comprising:

an energy recovery circuit;

a direct current voltage supply part for providing a direct current voltage; and an address driving part for applying a data signal generated from the direct current voltage without using the energy recovery circuit to a data electrode line during the selective erase sub-field, and the address driving part applying a plurality of data signals, which are sequentially produced with a ground level voltage between two data signals, generated from using the energy recovery circuit to the data electrode line during the selective write sub-field.

9. The driving device of a plasma display panel according to claim 8, wherein a value of a data-loading of the selective erase sub-field is less than a value of the data-loading of the selective write sub-field.

10. The driving device of a plasma display panel according to claim 8, wherein a minimum value of a voltage of a scan pulse applied to a scan electrode line during an address period of the selective write sub-field is less than a minimum value of a voltage of a set-down waveform applied to the scan electrode line during a reset period of the selective write sub-field.

11. The driving device of a plasma display panel according to claim 8, wherein a minimum value of a voltage of a scan pulse applied to a scan electrode line during an address period of the selective write sub-field is less than a minimum value of a voltage of a scan pulse applied to the scan electrode line during an address period of the selective erase sub-field.

12. A method for driving a plasma display panel for displaying an image in a frame having at least one selective write sub-field and one selective erase sub-field, the method comprising:

applying a data signal from a direct current voltage without using an energy recovery part to a data electrode line during the selective erase sub-field; and applying a plurality of data signals, which are sequentially produced with a ground level voltage between two data signals, generated from using the energy recovery part to the data electrode line during the selective write sub-field.

13. The method for driving a plasma display panel according to claim 12, wherein a value of a data-loading of the selective erase sub-field is less than a value of a data-loading of the selective write sub-field.

14. The method for driving a plasma display panel according to claim 12, wherein a minimum value of a voltage of a scan pulse applied to a scan electrode line during an address period of the selective write sub-field is less than a minimum value of a voltage of a set-down waveform applied to the scan electrode line during a reset period of the selective write sub-field.

15. The method of driving a plasma display panel according to claim 12, wherein a minimum value of a voltage of a scan pulse applied to a scan electrode line during an address period of the selective write sub-field is less than a minimum value of a voltage of a scan pulse applied to the scan electrode line during an address period of the selective erase sub-field.

* * * * *